United States Patent [19]

Baatz et al.

[11] Patent Number: 4,590,000

[45] Date of Patent: May 20, 1986

[54] METHOD AND APPARATUS FOR THE PACKAGING OF RADIOACTIVE WASTES

[75] Inventors: Henning Baatz; Dieter Rittscher; Hans-Joachim Lür, all of Essen, Fed. Rep. of Germany

[73] Assignee: GNS Gesellschaft fur Nuklear-Service mbH, Essen, Fed. Rep. of Germany

[21] Appl. No.: 483,244

[22] Filed: Apr. 8, 1983

[30] Foreign Application Priority Data

Apr. 10, 1982 [DE] Fed. Rep. of Germany ..... 3213497

[51] Int. Cl.[4] ..... G21F 9/36

[52] U.S. Cl. ..... 252/633; 53/467; 53/486; 53/527; 100/249

[58] Field of Search ..... 252/633, 626; 100/229 A, 229 R, 104, 249, 54, 58; 110/223; 53/467, 473, 476, 484, 485, 486, 489, 526, 527

[56] References Cited

U.S. PATENT DOCUMENTS

| | | | |
|---|---|---|---|
| 2,978,999 | 4/1961 | Smith | 100/229 A |
| 3,815,323 | 6/1974 | Longo | 100/229 A |
| 4,008,658 | 2/1977 | Stock et al. | 100/229 R |
| 4,102,262 | 7/1978 | Liberman et al. | 100/229 A |
| 4,409,029 | 10/1983 | Larker et al. | 419/10 |
| 4,462,310 | 7/1984 | Jackson et al. | 100/219 |

FOREIGN PATENT DOCUMENTS

| | | | |
|---|---|---|---|
| 0044381 | 1/1982 | European Pat. Off. | 252/628 |
| 2659691 | 11/1978 | Fed. Rep. of Germany | 252/626 |
| 3129852 | 2/1983 | Fed. Rep. of Germany . | |
| 0004661 | 1/1977 | Japan | 100/229 A |
| 0016880 | 2/1977 | Japan | 100/229 A |
| 1131629 | 10/1968 | United Kingdom . | |
| 1215265 | 12/1970 | United Kingdom | 252/626 |
| 1528478 | 10/1978 | United Kingdom | 252/626 |

*Primary Examiner*—Stephen J. Lechert, Jr.
*Assistant Examiner*—Howard J. Locker
*Attorney, Agent, or Firm*—Karl F. Ross; Herbert Dubno

[57] ABSTRACT

A method of and an apparatus for the packaging of radioactive waste wherein a steel container is placed in a horizontal hydraulic press chamber with the open end of the container turned toward a hydraulic ram, radioactive waste is accumulated ahead of the open end of this container, the ram is advanced to displace the radioactive waste into the container and then to corrugate the container wall and compress the radioactive waste against a retractable wall and the wall is then retracted to permit the ram to force the package out of the chamber.

5 Claims, 3 Drawing Figures

METHOD AND APPARATUS FOR THE PACKAGING OF RADIOACTIVE WASTES

FIELD OF THE INVENTION

Our present invention relates to the packaging of radioactive wastes for disposal and, more particularly, to a method of and an apparatus for the compacting of radioactive wastes to produce units in which the radioactive waste is at least in part enclosed in a metal shell.

BACKGROUND OF THE INVENTION

The packaging of radioactive waste can be carried out by compacting the product and storing the same in a standardized storage vessel composed in part of steel sheet, the canister being generally stored in subterranean facilities.

A standardized canister for this purpose may have a volumetric capacity of 200 to 400 liters and thus requires a sheet steel of corresponding thickness and strength.

The radioactive wastes which can be packaged in such canisters generally are radioactive waste products obtained from the various solids which are generated in the operation of nuclear power plants. Such materials can include textiles, e.g. contaminated garments, paper and the like.

In general, such materials are discarded in a nuclear power plant in waste collection vessels from which they are dumped into the canisters into which they are to be stored and the canisters may be stacked so that, in effect, a package can comprise a number of such containers in a tablet shape or compact configuration, more or less compressed radioactive wastes and even systems in which the containers are themselves compacted and caused to corrugate or deform in a more or less regular pattern. Indeed, it is known to dump the radioactive material into a steel canister and compress the resulting package to decrease the volume thereof while wrinkling or creasing or folding the walls thereof.

OBJECTS OF THE INVENTION

It is the principal object of the present invention to provide an improved method of packaging radioactive wastes which extends the principles of the earlier systems described.

Another object of the invention is to provide an improved apparatus for the packaging of radioactive wastes.

Yet a further object of the invention is to provide an improved method of and apparatus for the formation of compact packages in which a compressed radioactive mass is contained in a canister of high strength and small dimensions.

SUMMARY OF THE INVENTION

These objects and others which will become apparent hereinafter are attained, in accordance with the present invention, utilizing an apparatus for packaging radioactive waste which, in effect, employs a hydraulic press in a horizontal orientation, i.e. in a supine or prone position with a horizontally reciprocatable hydraulically actuated ram, a horizontal compressing chamber having a movable end wall and an inlet for radioactive waste spaced from the end wall and opening from above into this chamber, the space betweeen the inlet and the wall serving to accommodate a sheet steel canister.

According to the invention, after an empty canister has been inserted into the portion of the chamber immediately upstream of the wall in a retracted position of the ram, the radioactive waste is introduced into the chamber upstream of the mouth of the canister through the inlet and the ram is advanced toward the wall to drive the radioactive waste into the canister and then to engage the wall of the canister and collapse the latter in a series of corrugations or undulations, thereby compressing the canister axially and simultaneously compacting the radioactive mass within the axially compressed canister.

When the compacted assembly is finished, the wall is retracted and the ram advanced further to drive the assembly out of the pressing chamber. The ram can then be withdrawn, a new canister introduced into the chamber and the wall replaced in its original position where it again becomes an anvil against which the ram can drive the radioactive mass to compact it and then the canister is itself crushed.

According to another feature of the invention, the ram can drive a cover into or onto the canister when it is advanced to force the radioactive mass into the latter. This can serve to seal the cover on the canister.

In yet another aspect of the invention, the canister shell which is compressed by the ram against the retractable wall has outer dimensions which correspond to the inner dimensions of the chamber so that the shell lies in extremely close proximity to the chamber wall. This facilitates controlled distortion of the shell in the formation of the corrugated or folded canister wall. According to a feature of the invention, the cover can have an inwardly converging flange adapted to be driven into the shell during the compression thereof while the shell may be provided at axially spaced locations with annular inwardly bulging formations promoting uniform folding of the wall.

The system of the invention has the advantage that the radioactive waste need not be compacted separately, and thus a time consuming step is avoided and the associated extra handling is eliminated. The press chamber serves for accumulating and compresssing the radioactive waste and if such accumulation is required over a length of time, the filling opening can be provided with a closure through which the radioactive waste can be introduced. The compaction formation of the canister in its final form and sealing can be efffected in a single step with a simple apparatus and with a minimum of contact of personnel with the radioactive materials.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
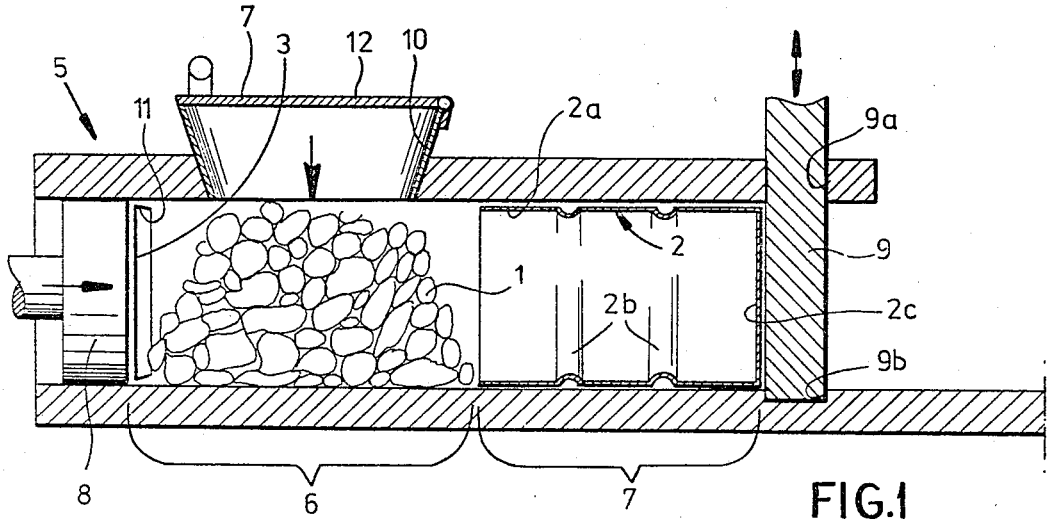
FIG. 1 is a diagrammatic axial cross-sectional view showing the apparatus as the radioactive materials are accumulated.

The apparatus shown in the drawing, for the packaging of radioactive waste, comprises a horizontal hydraulic press 5 whose ram 8, carried by the rod **8*a* is displaced by a hydraulic cylinder represented diagrammatically at 8b** and capable of developing extremely high forces.

The ram 8 is dimensioned to slide snugly in a press 5 which has a filling section 8 and a compression section 7, the latter receiving a steel shell 2 which is open to the left and abuts a retractable wall 9, the latter forming an anvil against which compression can be effected.

The wall 9 is guided in a slide 9a of the press and lodges in a groove 9b so that it cannot be deflected by the high compression force.

The steel shell 2 has a generally cylindrical wall 2a which is provided at axially spaced locations with annular inward bulges assisting in the controlled collapse of the wall 2a and a bottom 2c which rests against the wall 9 and is hermetically sealed to or unitary with the wall 2a.

The cover 3 having an inwardly converging flange 11 can be disposed adjacent the end face of the ram 8 in the retracted position of the latter (FIG. 1) to allow the accumulation of the radioactive material 1 in the region 6 upstream of the steel shell 2 whose open end is turned toward the ram 8.

An inlet funnel 10, spaced upstream from the wall 9 opens into the press 5 from above and allows the radioactive waste to be discarded through its funnel into the collection zone 6. A cover 12, which can be swung upwardly can be provided for the funnel 10 to allow the radioactive waste to be introduced over a period of time.

Figure 2:
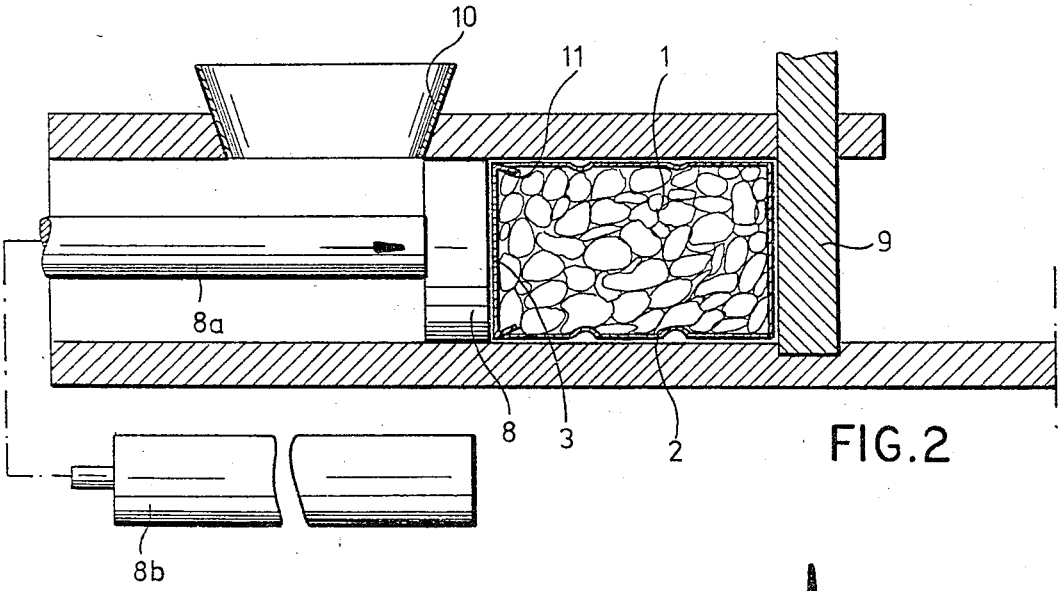
FIG. 2 is a view of the apparatus during compaction.

When a sufficient accumulation of radioactive waste has occurred, the ram 8 is displaced toward the wall 9 to initially drive the waste into the shell (FIG. 2) and seat the cover flange 11 in the open mouth of this shell.

The hydraulic pressure is increased and the displacement of the ram 8 continued to collapse the wall 2a and to form the undulating configuration 4a of the compressed container 4 which is the product. The container is, of course, of an axial length substantially less than that of the shell, the radioactive material 1 is highly compressed and the cover is seated tightly upon the canister.

Figure 3:
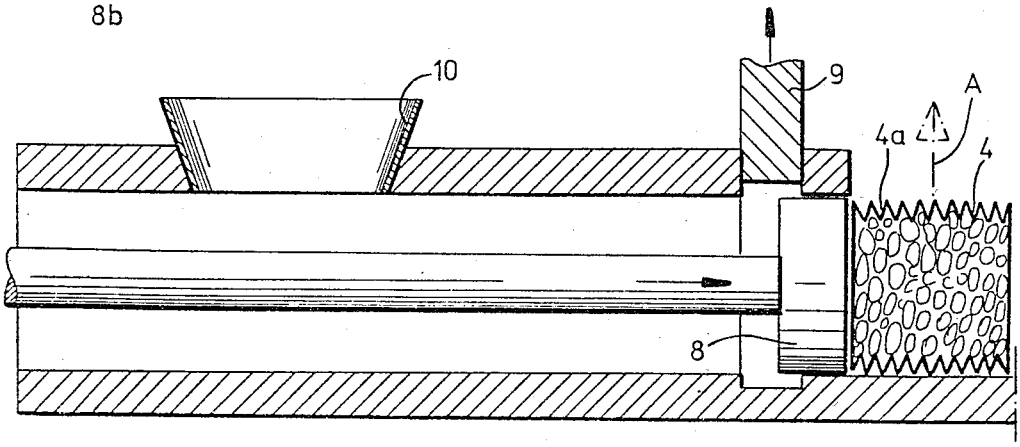
FIG. 3 is a view of the apparatus upon ejection of the package.

After the shell has been collapsed against the wall 9, the latter is retracted transversely (FIG. 3), and the ram 8 advanced still further to the right to drive the completed canister from the press in the form of a tablet whose walls are corrugated in a harmonic pattern. The package can be removed transversely (arrow A), the ram 8 is retracted to the left, a new shell is inserted into the region 7, the wall 9 closed and, after a cover is applied to the face of the retracted ram, accumulation of radioactive waste is begun again.

We claim:

1. An apparatus for forming a radioactive waste package comprising a horizontal hydraulic press having a substantially horizontal pressing chamber, a ram hydraulically displaceable through said chamber from one end of said press toward an opposite end thereof, a retractable wall at said opposite end forming an anvil, an inlet for radioactive waste opening from above into said chamber at a location spaced from said wall by a distance sufficient to accommodate a collapsible steel container in which waste introduced into said chamber upstream of said container can be compressed, said ram being displaceable to drive said waste into said container, to crush said container and to compress said waste within said container and the container itself against said wall by crushing the container, and to displace the crushed and compressed container and the compressed waste contained therein out of said chamber upon retraction of said wall, and a cover disposed between said opening and said ram in said chamber when said ram is positioned toward the end of said chamber opposite the end holding said container, whereby the driving by said ram of said waste into said container applies said cover to said container.

2. The apparatus defined in claim 1, comprising a cover on said inlet enabling the accumulation of radioactive waste in said chamber upstream of said container over an extended period of time.

3. A method of packaging radioactive waste which comprises the steps of:

(a) disposing an open end sheet steel container in a horizontal hydraulic press chamber against a retractable anvil-forming wall;

(b) introducing from above compressible radioactive waste through an opening into said chamber ahead of the open end of said container;

(c) positioning a cover in said chamber at an opposite side of said opening from said container;

(d) hydraulically advancing a ram through said chamber from behind said cover to advance said cover and drive said waste into said container while collapsing the wall of said container in a harmonic pattern to thereby compress said waste and form a compressed canister of radioactive waste in which the steel container and the waste therein are compressed and sealed by said cover; and (e) retracting said wall and advancing said ram to displace said canister from said chamber.

4. The method defined in claim 4, further comprising the step of preforming said container with axially spaced inwardly extending annular bulges to assure uniform corrugation of said wall of said container as said container is compressed against said wall.

5. The method defined in claim 3 wherein a new container is introduced into said chamber through an end of said chamber at which said wall is retracted and while said wall is retracted, said method further comprising the step of closing said end of said chamber by restoring the original position of said wall and repeating steps (b) through (d).

* * * * *